US006520718B1

(12) United States Patent
Nagatomo et al.

(10) Patent No.: US 6,520,718 B1
(45) Date of Patent: Feb. 18, 2003

(54) SARDINE-BONE CONSTRUCTION METHOD FOR LARGE-SECTION TUNNEL

(75) Inventors: Shigeki Nagatomo, Tokyo (JP); Hideo Fujimoto, Noda (JP); Shigehito Kaji, Nagareyama (JP); Hideki Takeuchi, Kodaira (JP); Yoshio Mitarashi, Yokohama (JP); Sohki Ohtsu, Fukuoka (JP); Tsuguo Takebayashi, Yokohama (JP); Masakazu Ochiai, Matsuyama (JP); Takefumi Yamamoto, Fukuoka (JP); Yoshitomo Kinoshita, Tokyo (JP)

(73) Assignee: Shigeki Nagatomo, et al. (JP)

( * ) Notice: Subject to any disclaimer, the term of this patent is extended or adjusted under 35 U.S.C. 154(b) by 0 days.

(21) Appl. No.: 09/763,993

(22) PCT Filed: Nov. 16, 1998

(86) PCT No.: PCT/JP99/06397

§ 371 (c)(1),
(2), (4) Date: Feb. 27, 2001

(87) PCT Pub. No.: WO00/32906

PCT Pub. Date: Jun. 8, 2000

(30) Foreign Application Priority Data

Nov. 27, 1998 (JP) ..... 10-338023

(51) Int. Cl.[7] ..... E21D 11/00

(52) U.S. Cl. ..... 405/139; 405/266; 405/287.1; 299/11

(58) Field of Search ..... 405/132, 138, 405/139, 258.1, 263, 266, 270, 272, 287.1, 288, 302.4; 299/11

(56) References Cited

U.S. PATENT DOCUMENTS

| | | | | | |
|---|---|---|---|---|---|
| 528,367 | A | * | 10/1894 | Harris | 405/138 |
| 721,830 | A | * | 3/1903 | Perin | 405/130 |
| 3,631,680 | A | * | 1/1972 | Thomson | 405/139 |
| 3,916,630 | A | * | 11/1975 | Arsuaga | 405/139 |
| 3,968,655 | A | * | 7/1976 | McGlothlin | 405/138 |
| 4,365,913 | A | * | 12/1982 | Bonvoisin | 405/132 |
| 5,118,220 | A | * | 6/1992 | Furumi et al. | 299/33 |
| 5,678,957 | A | * | 10/1997 | Lipsker | 405/141 |

FOREIGN PATENT DOCUMENTS

| | | | | |
|---|---|---|---|---|
| JP | 01137094 | A | | 5/1989 |
| JP | 05018194 | A | | 1/1993 |
| JP | 06017590 | A | | 1/1994 |
| JP | 06074715 | B | | 9/1994 |
| JP | 06264698 | A | | 9/1994 |
| JP | 06096844 | B | | 11/1994 |
| JP | 07076988 | A | | 3/1995 |
| JP | 10046978 | A | | 2/1998 |
| JP | 11159275 | A | | 6/1999 |
| JP | 11-200762 | A | * | 7/1999 |
| WO | WO99/28595 | | | 3/1998 |

* cited by examiner

*Primary Examiner*—Heather Shackelford
*Assistant Examiner*—John Kreck
(74) *Attorney, Agent, or Firm*—Young & Basile, P.C.

(57) ABSTRACT

This invention relates to a method for boring a large-section tunnel safely and quickly by reinforcing and improving in advance the ground over the full length of the tunnel section, which includes; boring a top drift (2) through the full length of the tunnel (1) section, drilling curved holes inclined in forward or backward directions at an angle of about 45 degrees at preset intervals from the top drift (2) along the peripheral edges of the sections of the tunnel (1) by using ordinary small bore rock drills and curved steel pipes (3), pulling off the steel pipes (3) after inserting injection pipes into the drilled holes, injecting grout into the ground surrounding the tunnel through the injection pipes to develop artificial ground arches (4), excavating the tunnel (1), advancing suspension forms (6) and placing concrete for secondary lining.

3 Claims, 4 Drawing Sheets

SARDINE-BONE CONSTRUCTION METHOD FOR LARGE-SECTION TUNNEL

TECHNICAL FIELD

The present invention relates to a construction method for boring a large-section tunnel safely and quickly by reinforcing and improving the ground surrounding the tunnel to develop artificial ground arches.

BACKGROUND ART

A construction method for boring a tunnel through weak ground by reinforcing the ground to increase its capability of self-support and prevent the tunnel from collapsing is shown in publication of patent application JP-1989-137094.

In this prior art, injection holes are drilled from the face of the tunnel into the ground surrounding the tunnel toward the tunneling direction. Then injection pipes are inserted into the drilled holes to inject grout into the injection holes for reinforcing the ground surrounding the tunnel. After the ground is reinforced, the reinforced part of the ground is excavated, and timbered and/or lined. The steps stated above are repeated to bore the tunnel.

DISCLOSURE OF THE INVENTION

In this prior construction method, however, drilling and injecting steps for reinforcing the ground, and excavating and lining steps for tunnel boring have to be repeated one after another at the face, so that the construction works are complicated and inefficient which result in a longer construction period.

An object of the present invention is to provide a construction method for boring a large-section tunnel safely and quickly by reinforcing and improving in advance the ground over the full length of the tunnel section.

In the sardine-bone construction method for large-section tunnel (SBR Construction Method) of the present invention, for solving the problem stated above, drifts are bored through the full length of the tunnel section, then curved holes inclined in forward or backward directions at an angle of about 45 degrees are drilled at preset intervals from the drifts along the peripheral edges of the sections of the tunnel by using ordinary small bore rock drills and curved steel pipes, the steel pipes are pulled off after injection pipes are inserted into the drilled holes, grout is injected into the ground surrounding the tunnel through the injection pipes to develop artificial ground arches, then the tunnel is excavated, suspension forms are advanced and concrete is placed for secondary lining, whereby the tunnel is bored.

In the construction method, at first, drifts are quickly bored through the full length of the tunnel section. Then curved holes are drilled by using rock drills and curved steel pipes, the steel pipes are pulled off after injection pipes are inserted into the drilled holes, grout is injected into the ground surrounding the tunnel through the injection pipes. Because these steps are executed from the drifts, the works are efficiently completed. It is different from doing the works at the face at intervals of excavating.

In addition, drilling curved holes and injecting grout can be simultaneously executed at more than one places so that the artificial ground arches are quickly developed, since the steps of reinforcing and improving ground are executed after the drift is bored through the full length of the tunnel.

At the face, only excavating and lining steps are continuously executed, so that the boring works are uncomplicated and efficient.

A top drift is suitable for developing artificial ground arches when the tunnel is bore d by adopting an upper half section advancing excavation method.

If drifts are placed in the middle of the side-walls of the tunnel, curved holes are drilled upward along the peripheral edges of the section of the tunnel from the drifts to the top of the tunnel. This is suitably used for excavating upper half unit of the tunnel through weak ground.

BEST MODE FOR PRACTICING THE INVENTION

Figure 1:
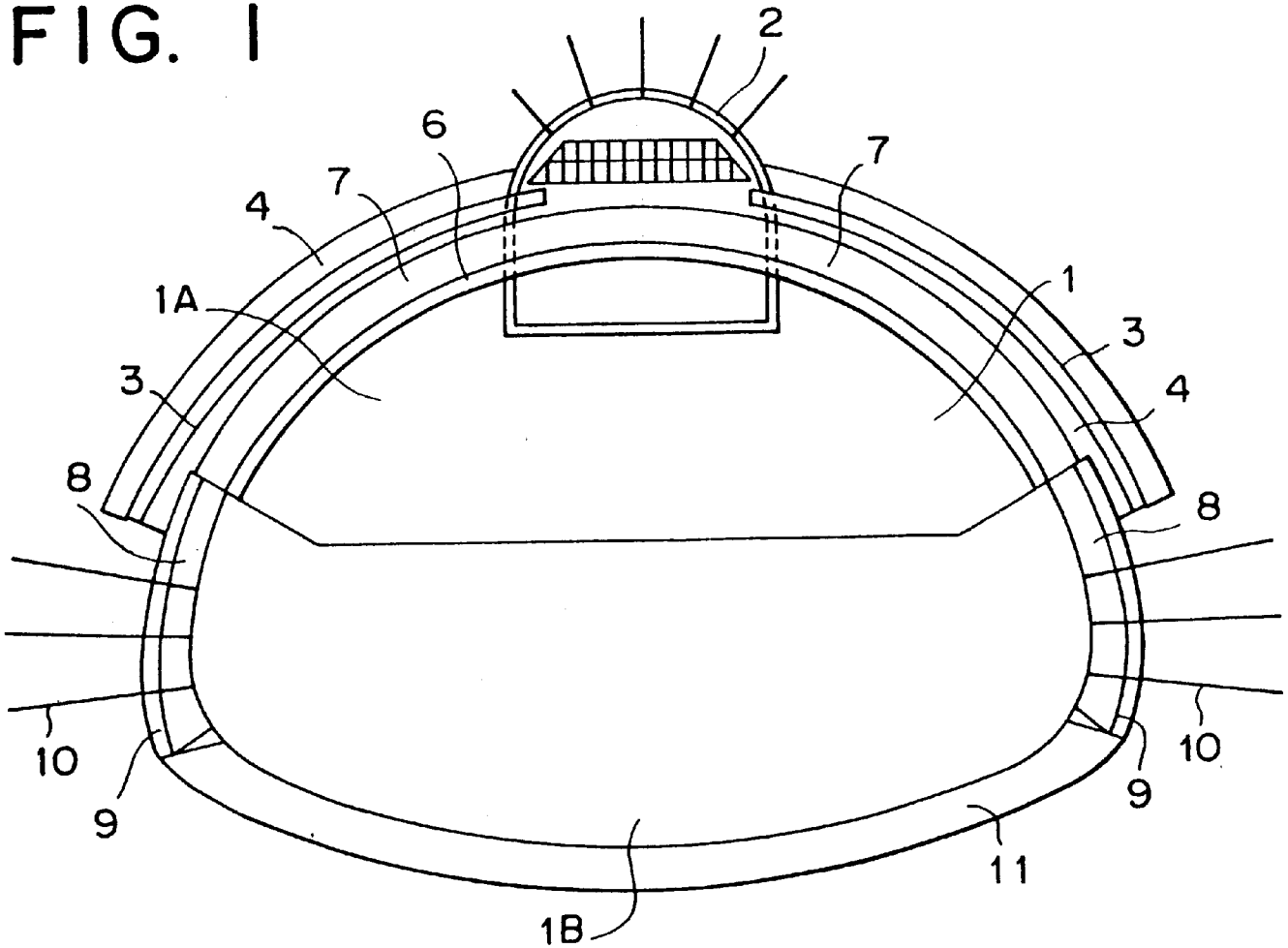
FIG. 1 is a drawing explaining an embodiment of a sardine-bone construction method for large-section tunnel according to the present invention, which is sectional view of a large-section tunnel having a top drift.

The present invention is to be explained for an embodiment of the present invention.

When a large-section tunnel 1 is bored, at first, a top drift 2 about 5 m wide is bored swiftly through the full length of the tunnel 1 by using excavating machines such as a tunnel boring machine (TBM) or a side type road header (RH).

Then curved holes are drilled along the peripheral edges of the section of the tunnel 1 by using ordinary rock drill 20 and curved steel pipes 3. In this step, curved steel pipes, 120 mm across and about 1.5–2.0 m long, are connected in accordance with the advance of drilling.

After injection pipes such as Mannschet tube (not shown) are inserted into the drilled holes, the curved steel pipes 3 are pulled off, and grout is injected into the ground surrounding the tunnel through the injection pipes to develop artificial arches 4.

In the injection step, high pressure cement grout is injected into the ground using double pipes double packers to reinforce the ground to 3 MPa or higher in uniaxial compression strength within the area of about 2 m outside from the injection pipes.

Intervals of the injection pipes toward the tunneling direction are determined in the range of 1.5–2 m according to the conditions of the ground. Directions of the injection pipes are inclined by drilling curved holes forward or backward about 45 degrees in connection with the curvature of curved holes.

Figure 2:
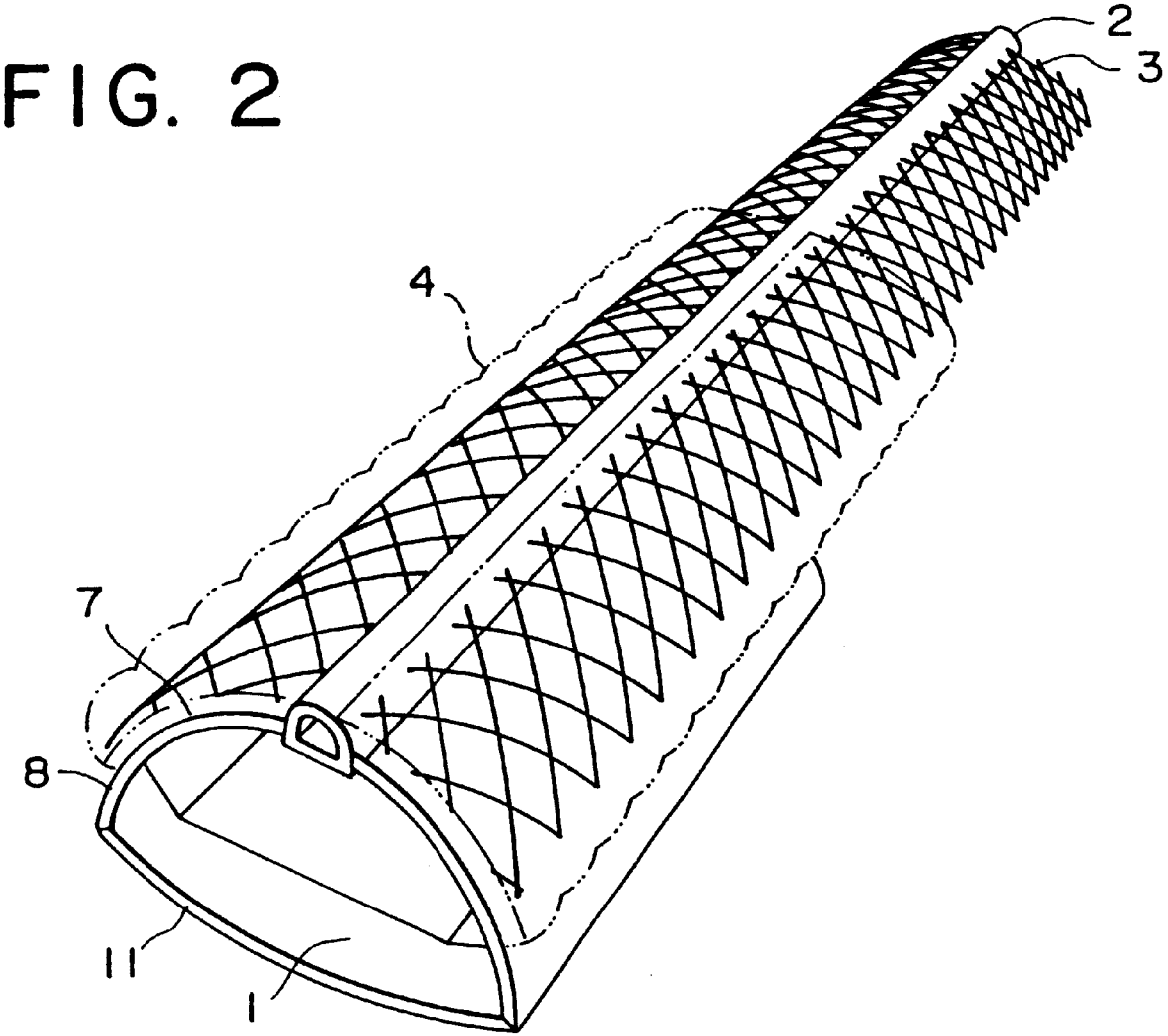
FIG. 2 is a drawing showing a large-section tunnel having a top drift, which is a schematic perspective view.
Figure 3:
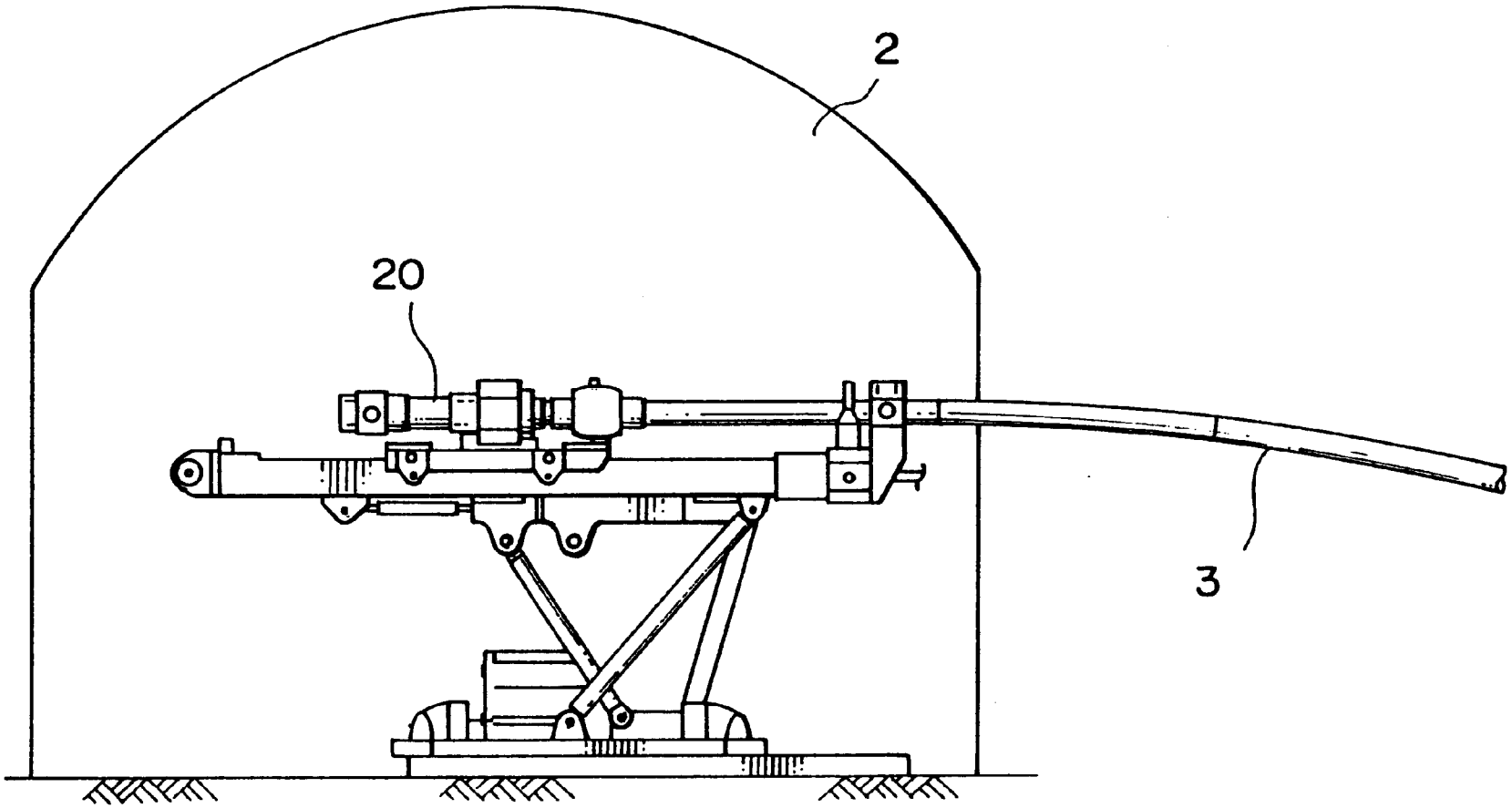
FIG. 3 is a drawing explaining curved-hole-drilling by using rock drills and curved steel pipes.

The artificial ground arches 4 shaped like sardine-bones, shown in FIG. 2, are developed over the arch of the tunnel 1 by execution of the steps stated above.

After the artificial ground arches 4 are completed, the upper half unit 1A of the tunnel 1 is excavated in the rate of 1.5–3 m/cycle. Usually, the ground having 150 MPa class strength are excavated mechanically by using large type breakers (Bk) and side type road headers (RH).

Soon after the excavation, the suspension forms 6 are advanced and quick setting concrete mixed with 40–50 $kg/m^3$ of steel fiber is placed for completing secondary lining of arch unit 7.

Mechanical excavation is also preferable for excavating the lower half unit 1B. If necessary, blasting for loosening the face can be used together. Shotcrete 9 and lock bolts 10 are carried out on the side wall unit 8. Steel fiber reinforced concrete generally used for lining of side wall unit 8 and invert unit 11. Volume of Steel fiber in the concrete is suitably adjusted. In joint grouting between upper half and lower half, materials such as low viscosity acrylate resin are injected after plastic pipes are set to stop water.

As described above, at first, the top drift 2 is quickly bored through the full length of the tunnel section. Then curved holes are drilled by using rock drills 20 and curved steel pipes 3, the steel pipes 3 are pulled off after injection pipes are inserted into the drilled holes, grout is injected into the ground surrounding the tunnel 1 through the injection pipes. Because these steps are executed from the top drift 2, the works are efficiently completed. It is more efficient than doing the works at the face at intervals of excavating.

Moreover, drilling curved holes and injecting grout can be simultaneously executed at more than one places so that the artificial ground arches 4 are quickly developed, because the steps of reinforcing and improving ground are executed after the top drift 2 is bored through the full length of the tunnel 1.

The tunnel 1 is excavated after the artificial ground arches 4 are completed, so that excavating works are safely executed. The upper half unit 1A and the lower half unit IB are advanced independently, and at the faces, only excavating and lining steps are continuously executed, so that the boring works are uncomplicated and efficient.

Figure 4:
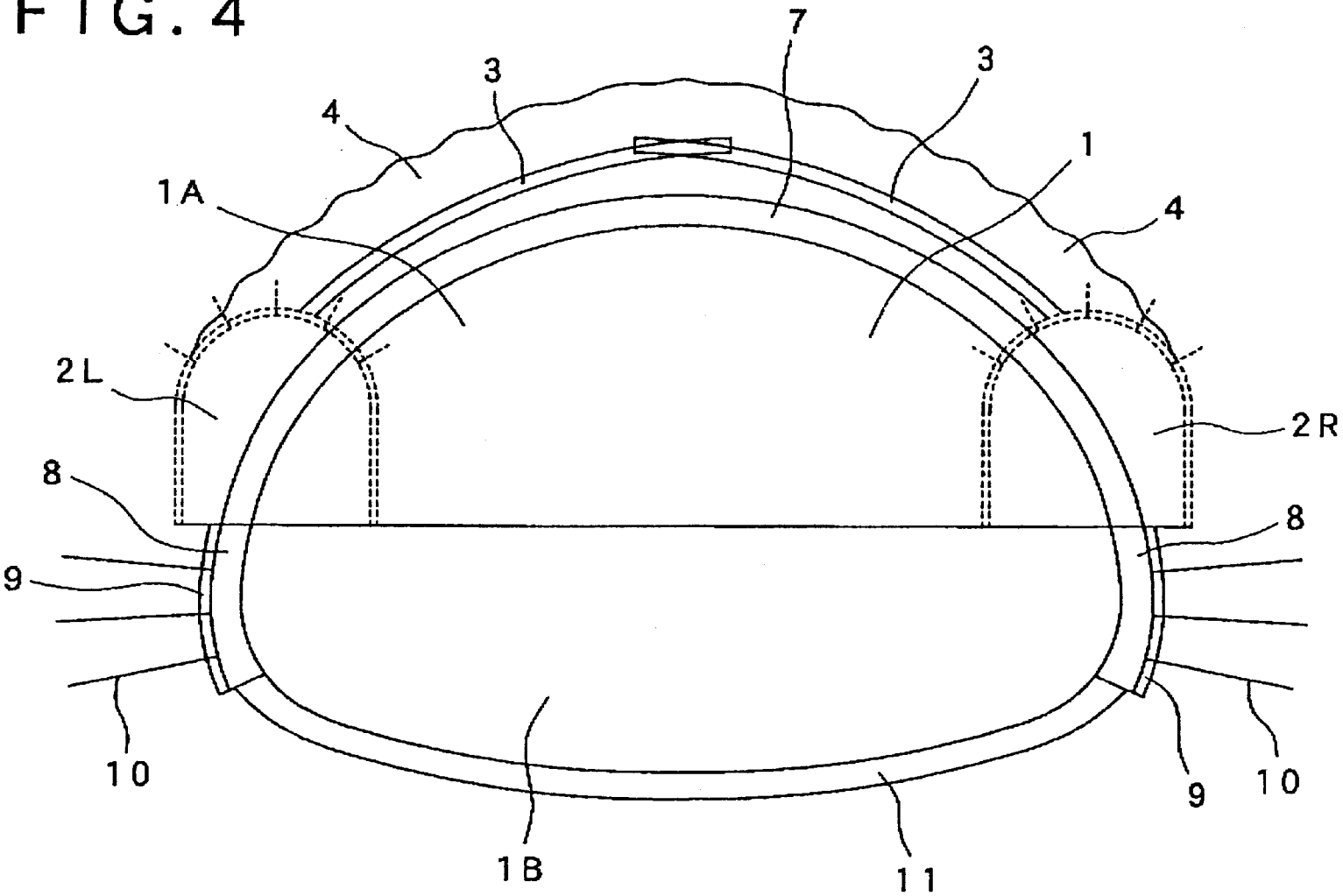
FIG. 4 is a sectional view of a large-section tunnel having drifts in the side walls of the tunnel.

According to ground conditions, drifts 2L, 2R, shown in FIG. 4, can be placed in the middle of the side walls of the tunnel 1. In this case, drifts 2L, 2R are bored through the side walls. Then curved holes are drilled upward along the peripheral edges of the section of the tunnel 1 from the drifts 2L, 2R to the top of the tunnel 1, the steel pipes 3 are pulled off after injection pipes are inserted into the drilled holes, grout is injected into the ground surrounding the tunnel through the injection pipes to develop artificial ground arches 4. The tops of the left-hand steel pipes and the right-hand steel pipes are not required to reach the same position.

INDUSTRIAL APPLICABIILTY

As has been described above, according to the construction method of the present invention, large-section tunnel can be safely and quickly bored by reinforcing and improving in advance the ground over the full length of the tunnel section.

What is claimed is:

1. Sardine-bone construction method for large-section tunnel, wherein the method comprising steps of:

boring one or more drifts through the full length of the tunnel section;

drilling curved holes inclined in forward or backward directions at an angle of about 45 degrees, at preset intervals from the drifts along the peripheral edges of the sections of the tunnel by using ordinary small bore rock drills and curved steel pipes;

pulling off the steel pipes after inserting injection pipes into the drilled holes;

injecting grout into the ground surrounding the tunnel through the injection pipes to develop artificial ground arches;

excavating the tunnel;

advancing suspension forms; and placing concrete for secondary lining.

2. Sardine-bone construction method for large-section tunnel as defined in claim 1, wherein a drift is a top drift.

3. Sardine-bone construction method for large-section tunnel as defined in claim 1, which includes the drifts placed in the middle of the side walls of the tunnel.

* * * * *